United States Patent [19]

Wenger

[11] Patent Number: 4,575,982

[45] Date of Patent: Mar. 18, 1986

[54] PANEL UNIT

[76] Inventor: Hans Wenger, CH-8574, Lengwil/TG, Switzerland

[21] Appl. No.: 675,614

[22] Filed: Nov. 28, 1984

Related U.S. Application Data

[63] Continuation-in-part of Ser. No. 409,143, Aug. 18, 1982, abandoned.

[51] Int. Cl.[4] ..... E04B 1/38; E04B 1/62

[52] U.S. Cl. ..... 52/509; 52/384; 52/512; 52/595; 52/811

[58] Field of Search ..... 52/480, 595, 506, 508, 52/509, 512, 384, 811

[56] References Cited

U.S. PATENT DOCUMENTS

| | | | |
|---|---|---|---|
| 1,789,576 | 1/1931 | Bowman | 52/509 |
| 2,865,505 | 12/1958 | Andersson | 52/508 |
| 3,909,998 | 10/1975 | Simpson | 52/509 |
| 4,184,301 | 1/1980 | Anderson | 52/512 |
| 4,262,464 | 4/1981 | Ludowici | 52/512 |

FOREIGN PATENT DOCUMENTS

| | | | |
|---|---|---|---|
| 2600792 | 7/1977 | Fed. Rep. of Germany | 595/ |

*Primary Examiner*—Alfred C. Perham
*Attorney, Agent, or Firm*—Paul H. Gallagher

[57] ABSTRACT

This panel unit consists of several boards, driven together, which are fastened to each other, in the preferred manner of tongue-and-groove boards, and with an insulation mat applied to one side of the boards, distinguished in that fastening connected across the long axis of the boards and fastened thereto, and that the insulation mat is glued onto this side of the panel unit. The fastening strips have offsets at their ends, of different offset depths on each end, these fastening strips being connected together at their meeting ends, forming spacing accommodating the insulation mat.

8 Claims, 8 Drawing Figures

PANEL UNIT

Continuation-in-part of prior application Ser. No. 409,143, filed Aug. 18, 1982, now abandoned.

DESCRIPTION OF A PREFERRED EMBODIMENT

The invention refers to a panel unit, consisting of several boards or panels driven together and attached to each other by this means, forming a superior tongue-and-groove system, and with insulation placed on one side.

Such panel elements, or panels, were formerly made of tongue-and-groove boards fitted together. The fastening to the wall ensued with the help of fastening claws, whereby the groove gripped the tongue of a board, and a nail secured it through its extension to a lattice work, or lath, or a lath scaffold. The lath work was pinned to the wall. The disadvantage in such case is that it is especially difficult to introduce insulation because it had to be cut so that the hollows of the latticework could be filled satisfactorily. Moreover, a secure fastening of the insulation is essential.

The lath grid with its separated laths made a poor insulator and was practically a bridge for heat loss from the back-side of the panel unit to the relatively cold wall. It is also disadvantageous that every board had to be specially fastened with its tongue and groove to the latticework so that an extraordinarily high installation expense resulted.

The invention lays that problem to rest by the panel unit of the present kind, which distinguishes itself by a very good thermal insulation, and the installation of which is significantly less expensive, and in the course of installation, the new type of panel unit, while being lower in production cost, is easily adapted to the various dimensions to be encountered in installation.

To the end of solving this task is the invention characterized; a fastening band is provided on one side of the siding boards, connected in a crosswise direction to the boards or plates, and the insulation is glued to this side of the panel unit.

It thus consists of a mat or plate of suitable insulation material, with a direct and durable glued bond to the back side of the panel element. The connection of the boards which are fitted together, follows in a very simple way by means of the parallel bands at suitable intervals to one another, which are fastened with clamps on the back side of the boards; in doing so, the clamps are to be employed in a direction across the long axis of the boards. The panel units can now be prefabricated in their desired respective dimensions, which then can be fastened directly, which is to say without lattices or firring strips, on the wall or floor or ceiling under construction, with their insulation, by means of screws.

It is assumed here that fastening screws are at hand, passing through the insulation, and which are screwed into a permanent part of the building, namely the wall or floor or ceiling, and whose heads are concealed by the boards. Thus, one cannot see the fastening screws in the outer surface of the panel unit and yet a secure fastening of the individual panel units to the wall or floor or ceiling ensues, indeed by the screws covered by the plates or boards. The fastening is very good, because an entire sheet of insulation is glued to the back side of the boards or panels.

In order to make possible a satisfactory job of attaching the fastening strips with the boards attached to each other, it is preferable to fill any cuts, notches, nap or roughness or indentations so that a full surface glue adhesion will result over the spots between these bellies, naps, and the like.

The juncture of two such panel units with each other can also be successfully done on the fastening strips and fastening screws, whereby in addition to this the securing strips have offsets crimped together at the ends of each, the offsets having slots, which extend parallel to the plane of the panel unit, whereby the fastening screws are passed through them; one offset corresponds to the approximate thickness of the insulation, and the other offset is as deep as the screwheads used.

Here, the lower fastening screws have a projection consisting of a machine threaded rod, and a spacing sleeve is screwed onto this, its length corresponding to the approximate dimension between the fastening strips.

The two offset ends of the fastening strips are then pushed open, and with their slots thus pushed onto the common fastening screw, are held there and clamped between the spacing sleeve and the fastening screw. The fastening screw thus accomplishes two functions: first, it serves to attach the unit to the wall or floor, and secondly connects two adjacent panels together, and it also has the advantage of a tongue-and-groove joint.

As usual, a tongue-and-groove junction of the boards is preferred. It does not, however, need to be of wooden boards. It can also be dealt with in the case of metal plates. Also, veneered boards, usually of spruce or pine, and the like, can be thus provided for. The insulation consists advantageously of a sheet of suitable insulating material; for example, rock-wool, fiber (spun) glass, or the like. It can also be made of sheets or mats of plastic foam.

The following examples of embodiments of the invention, out of which further important characteristics emerge, will help to explain the nature of the invention.

Figure 1:
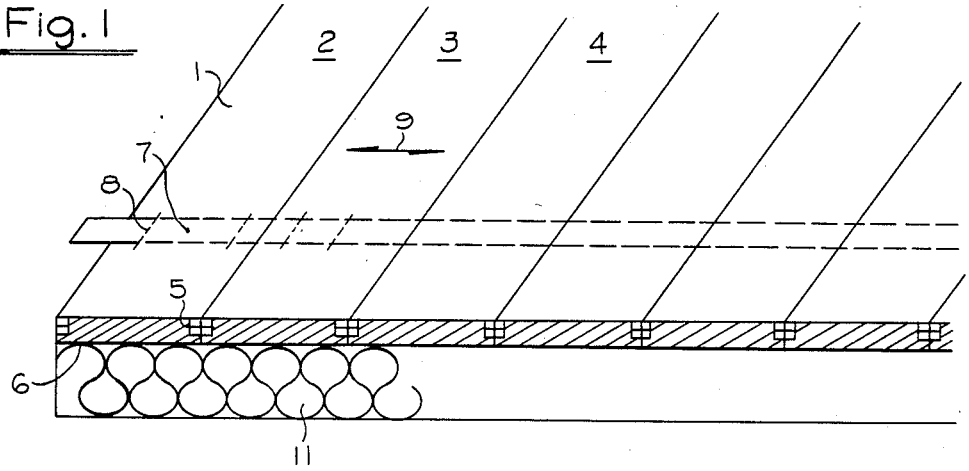
FIG. 1 is a perspective view of a new type of panel in its essential construction.

In FIG. 1, one sees a panel unit, consisting of several aligned tongue-and-groove boards 2, 3, and 4 with tongue-and-groove junctures 5. The back-sides 6 of the boards 2, 3, and 4 are bound together by fastening strip 7, whereby several fastening strips are arranged in intervals parallel to each other. The attachment of the fastening strips 7 to the boards 2, 3, 4 is accomplished through clips 8 which are, like the fastening strips, made of an aluminum alloy. The clips allow limited movement of the boards 2, 3, 4 in the direction of arrow 9, so that undesirable warping of the assembled panel unit is avoided.

The back-side 6 of this panel unit 1 is this example, shown with a rock wool mat or sheet 11 glued to it, in which corresponding naps, or buttons, are formed by prior impression by machine, in the manufacture thereof. Accordingly it is of such character that the glue is only on the surface of the naps 12, and thereby only the naps are glued to the back-side 6 of the panel unit 1, and the interstices 13 between the naps 12, are free of glue, and thereby the required freedom of movement in the directions of the arrow 9 is assured.

Any necessary amount of insulation can be introduced and glued in place, such as, for example, in thicknesses of from 10 to 80 mm.

Figure 3:
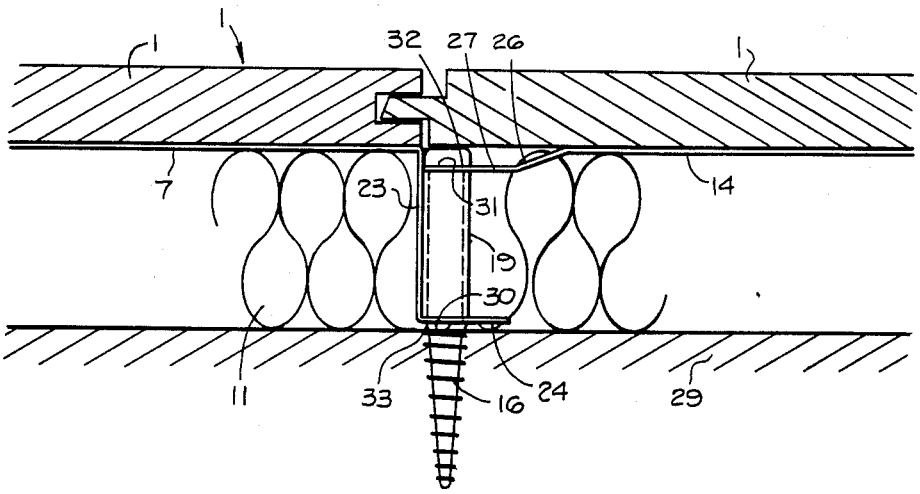
FIG. 3 is a cross-section through the two panel units of FIG. 2A fitted together and secured to a wall.
Figure 4:
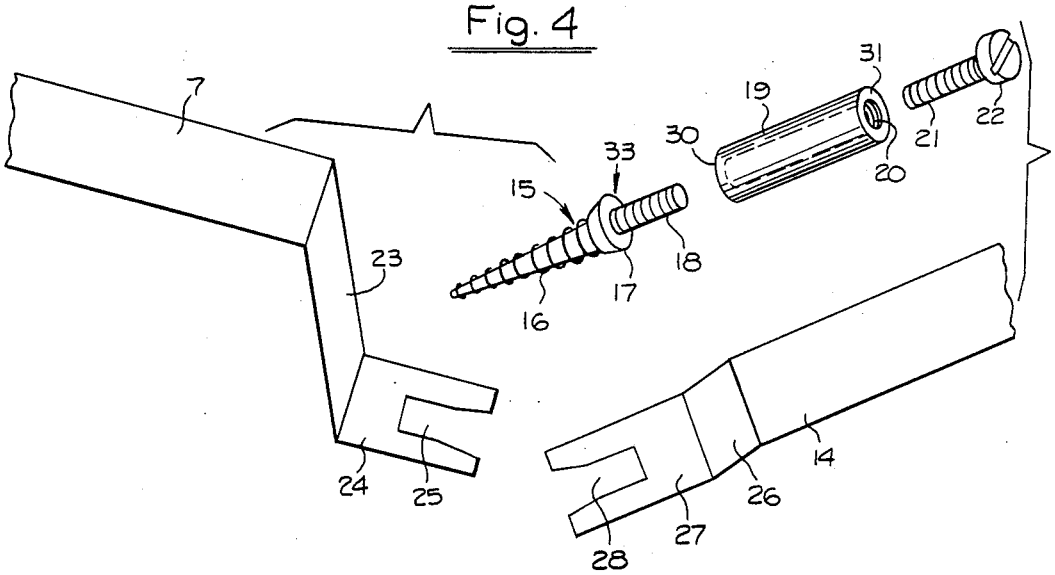
FIG. 4 is a perspective representation of a right-and left-hand fastening strips, with a fastening screw for both fastening strips.

In the drawing of FIG. 1, a straight fastening strip 7 is shown. This is due to a section of the assembly being shown, but in reality the fastening strip is offset at the ends, as is represented in FIGS. 3 and 4. In FIG. 3, the fastening strip 7 and another fastening strip 14 are fastened together, to the boards 2 and 3, and to the insulation plate 11, through a fastening screw 15. The fastening screw consists of a wood screw 16 with an attached connector 17. Secured in the connector, 17, is a screw 18 of smaller diameter than the wood screw, it having a machine thread of metric dimension. A spacing sleeve 19 is attached to the machine screw 18, and it has an internal thread 20 running through its length, so that a fastening screw 21 with a fillister head 22 can be screwed into its upper end.

The left fastening strip 7 (FIGS. 3 and 4) has an offset shank 23, which continues into another offset 24 parallel to the fastening surfaces, and the offset 24 being slotted at 25.

The right fastening strip 14 has a smaller offset, 26, which ends in a second offset 27, similar to the offset 24 of the other fastening strips, which is likewise slotted, at 28.

Figure 2:
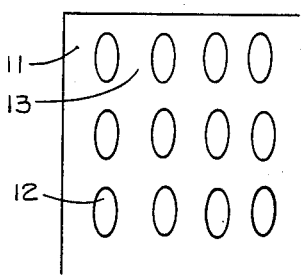
FIG. 2 is a view of the front side of the insulation utilized in FIG. 1.
Figure 2A:
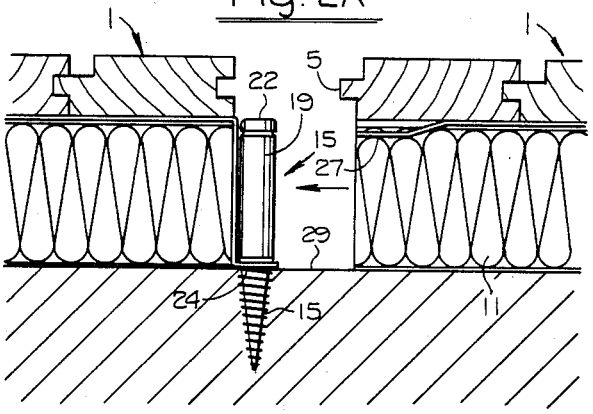
FIG. 2A is a cross-section through two panel units in a step of securing them to a wall.

The mode of attachment is as follows: referring to FIG. 2A, first, the fastening screw 15 is screwed into a pilot hole bore in the fastening surface 29 at a predetermined point, corresponding to the panel. The installation of this screw is as shown in FIG. 3, that is, it is screwed into a fastening, or supporting, surface with a tool that is screwed onto the machine threads 18, and without the spacing sleeve or fastening screw 21 in place. Now only the connector 17 and the machine screw 18 project from the fastening surface. The slot 25 is then pushed onto the connector 17, and the spacing sleeve 19 is turned onto the machine screw, so that the lower front end 30 of the spacing sleeve tightly clamps the offset 24 of the left fastening strip 7 between itself and the connector 17.

After screwing down the spacing sleeve 19 and clamping the left fastening strip 7, the fastening screw 21 is easily screwed into the inner threads of the spacing sleeve, and is so screwed to an extent leaving a slot 32 between the screw head 22 and the spacing sleeve. After this step, and referring to FIGS. 2A and 3, the right-hand panel unit 1, and thus the fastening strip 14, is pushed together with the panel unit 1 (to the left), so that the slot 28 receives the screw 21 and the fastening strip is positioned on the other end surface 31 of the spacing sleeve. It follows that the holding slot 32 serves only to hold the fastening strip, while the lower slot 33 between the spacing sleeve and the connector 17, is utilized as a clamping slot.

In this manner, the panel units 1 can be joined together effortlessly, whereby a very low installation cost results, because even with cramped quarters attachment, sometimes in a distance of, for example, 60 cm., only one operation of this kind must be dealt with at a time, and because of a single running of the fastening screws into the wall, the other board with its fastening strip 14 only need be pushed into the holding slot 32, and another fastening is not necessary. The boards thus remain tightly fastened on one side with the fastening screws first screwed over the clamping slot 33, and on the other side above the holding slot 32 connected to the other board.

Figure 5:
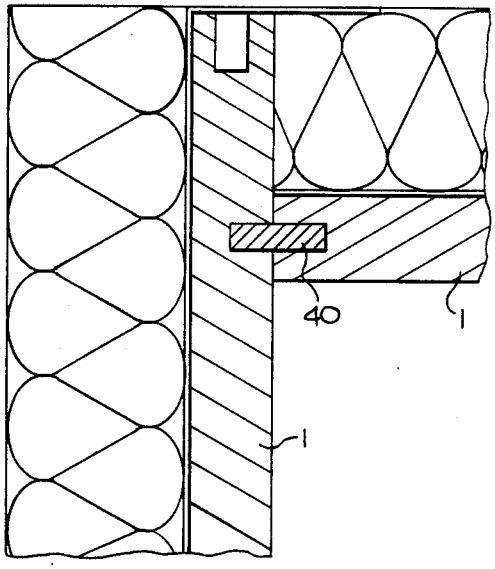
FIG. 5 is a cross section representing a corner juncture with the new type of panel units.
Figure 6:
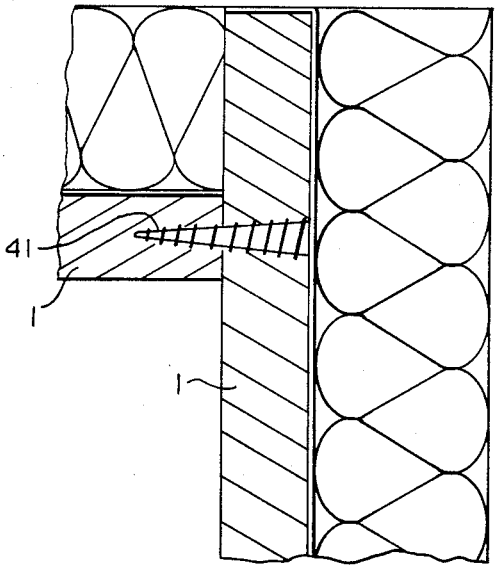
FIG. 6 is a cross section corresponding to FIG. 5, with a modified form of the new type of corner joint.

Corner abutments are represented in FIGS. 5 and 6, where one sees that one panel unit 1 is fastened by a dowel 40 to the other panel unit 1.

FIG. 6 shows a variation, where a panel unit 1 is connected to another panel unit 1 on one screw driven into the facing surface, screwed into the board at a distance from the outside mating surfaces, wherewith the entire fastening can be pushed together at the corner.

In the use of the invention, the substantial advantage is apparent that units of popular widths can be fitted with a material of excellent insulating properties, whereby tongue-and-groove boards can be connected together as well as plain solid wooden boards or veneer panels.

The same arrangement can also be fastened to the floor or ceiling and of course, in popular lengths; just as an installation to outer surfaces is possible, for example when a facing of plastic panels is undertaken to be installed, or an aluminum panel is to be equipped with an insulating material. Such aluminum plates are similar to tongue-and-groove joints, which panels can have corresponding insulating material attached, and be installed just as in the manner of the invention.

Figure 7:
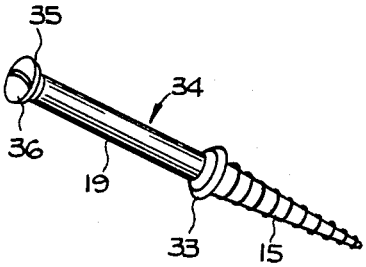
FIG. 7 is a perspective view of an alternative form of the fastening screw relative to that shown in FIGS. 3 and 4.

It is not mandatory that one employ the fastening screw 15 with spacing sleeve and fastening head according to fastening screw 21. FIG. 7 shows a variant form, where another fastening screw 34 is depicted. This fastening screw 34 has, as the above-described fastening screw 15, a clamping slot at 33 formed by screwing the spacing sleeve 19 onto the inner machine-screw a certain extent. The fundamental difference of fastening screw 15 of FIG. 4 lies in that a separate fastening screw 21 is employed, rather than, as in FIG. 7, the holding slot 35 is formed by impression, and the head 36 is connected integrally with the spacing sleeve 19.

I claim:

1. A panel unit including a plurality of boards fitted together by tongue-and-groove elements, adapted to be applied to a wall with other panel units in mutual edge-to-edge engagement, and having an outer surface, and an inner surface directed to the wall, characterized in that, a fastening strip is secured to said inner surface, extending across the long axes of the boards, a mat of insulating material is glued to said inner surface, mounting screws are secured in the wall adjacent to but outwardly beyond the edge of a panel unit, extending transverse to the plane of the panel unit and wall and confined between said inner surface and the wall, and thereby covered by the adjacent panel unit, the fastening strips on adjacent panel units have mutually oppositely directed offsets of differet depths, extending parallel to the inner surface of adjacent panel units, an inner offset being adjacent the wall and an outer offset adjacent to but spaced from said inner surface, said offsets having slotted end elements engaging the securing screw spaced apart substantially the thickness of the mat of insulating material.

2. A panel unit according to claim 1, characterized in that the secured screw has an outer end directed away from the wall and an inner end directed toward the wall, the securing screw includes a head at its outer end, and the said outer offset engages the securing screw at a position inwardly of the head.

3. A panel unit according to claim 2, characterized in that, the securing screw includes an inner end penetrated into the wall and a threaded stem extending outwardly therefrom, an intermediate threaded sleeve having an outer end away from the wall threaded on said stem and gripping said inner offset between said threaded sleeve and said inner end of the screw element, and said sleeve being of a length nearly the depth of the space between said offsets and thereby nearly the thickness of the mat of insulation material.

4. A panel unit according to claim 3, characterized in that, the securing screw is threaded in the sleeve with a head adjacent the outer end of the sleeve, and the outer offset is positioned between the sleeve and the head of said outer screw element.

5. A panel unit according to any one of claims 1 to 4, characterized in that, the side of the mat of insulation material engaging said inner surface is provided with naps and grooves.

6. A panel unit according to any one of claims 1 to 4, characterized in that, the fastening strips are so secured to the boards by clips spaced along the fastening strips, in which the fastening strips are loosely confined, thereby enabling limited transverse movement of the boards longitudinally of the fastening strips to avoid undesirable warping.

7. A panel unit according to claim 6, characterized in that, the fastening strips and clips are formed of aluminum material.

8. A panel unit assembly comprising, a plurality of units each having an inner surface adapted to engage a wall on which it is to be fitted, rigid securing strips mounted on said inner surface, extending transversely and each having offsets at its ends, a first offset at one end being spaced a relatively greater extend from said inner surface and a second offset at the other end spaced a relatively lesser amount therefrom, securing means operable for securing the first offset on a first panel to the wall, and holding the panel against displacement, and operable for receiving the second offset on a second panel by sliding the second panel transversely against the first panel, and the securing means being thereby operable for holding the second panel against separation from the wall, and similar securing means operable for securing the offset on the far edge of the second panel to the wall and thereby holding the second panel against separation from the first panel and holding the far edge of that panel against displacement, each unit including an outer board having an inner surface and a mat of insulation thereon.

* * * * *